US011199353B2

(12) United States Patent
Kehr

(10) Patent No.: US 11,199,353 B2
(45) Date of Patent: Dec. 14, 2021

(54) COOLER WITH A SECONDARY COMPARTMENT

(71) Applicant: Jeffrey Kehr, Rifle, CO (US)

(72) Inventor: Jeffrey Kehr, Rifle, CO (US)

( * ) Notice: Subject to any disclaimer, the term of this patent is extended or adjusted under 35 U.S.C. 154(b) by 193 days.

(21) Appl. No.: 16/299,424

(22) Filed: Mar. 12, 2019

(65) Prior Publication Data

US 2019/0285329 A1 Sep. 19, 2019

Related U.S. Application Data

(60) Provisional application No. 62/644,885, filed on Mar. 19, 2018.

(51) Int. Cl.

| | |
|---|---|
| ***F25D 3/08*** | (2006.01) |
| ***B65D 81/38*** | (2006.01) |
| ***B65D 43/16*** | (2006.01) |
| ***B65D 25/30*** | (2006.01) |
| ***B65D 25/04*** | (2006.01) |

(52) U.S. Cl.

CPC ..... *F25D 3/08* (2013.01); *B65D 25/04* (2013.01); *B65D 25/30* (2013.01); *B65D 43/16* (2013.01); *B65D 81/3825* (2013.01)

(58) Field of Classification Search

CPC .... F25D 3/08; F25D 21/14; F25D 2303/0844; F25D 2303/081; B65D 81/3825; B65D 43/16; B65D 25/30; B65D 25/04; A45C 11/20

USPC ..... 62/457.7, 457.2; 220/915.1, 915.2

See application file for complete search history.

(56) References Cited

U.S. PATENT DOCUMENTS

| | | | | |
|---|---|---|---|---|
| 6,026,978 | A * | 2/2000 | Clegg | F25D 3/08 220/592.1 |
| 6,349,559 | B1 | 2/2002 | Hasanovic | |
| 6,357,252 | B1 * | 3/2002 | Rand | A45C 11/20 62/457.2 |
| 6,536,228 | B1 * | 3/2003 | Hall | F25D 3/08 62/457.2 |
| 8,256,242 | B1 | 9/2012 | Evans | |
| 2003/0173361 | A1 | 9/2003 | Lee | |
| 2004/0093892 | A1 * | 5/2004 | Abfalter | F25D 3/08 62/457.7 |
| 2010/0275642 | A1 | 11/2010 | Klettner | |

* cited by examiner

*Primary Examiner* — King M Chu

(74) *Attorney, Agent, or Firm* — Boudwin Intellectual Property; Daniel Boudwin

(57) ABSTRACT

A cooler with a secondary compartment. The cooler with a secondary compartment has a base and at least one sidewall disposed around a perimeter of the base thereby defining an interior volume. A lid can be removably secured to an open end of the sidewall. A selectively removable tub can be dimensioned to fit within the interior volume. In one embodiment, at least one interior shelf is disposed in the interior volume thereby forming a first compartment and a secondary compartment, such that the first compartment is in thermal communication with the secondary compartment. In one embodiment, at least one door can be disposed on the sidewall wherein the door provides access to the interior volume. In another embodiment at least one drawer, dimensioned to fit within the interior volume, can be slidably removable.

13 Claims, 3 Drawing Sheets

COOLER WITH A SECONDARY COMPARTMENT

CROSS REFERENCE TO RELATED APPLICATIONS

This application claims the benefit of U.S. Provisional Application No. 62/644,885 filed on Mar. 19, 2018. The above identified patent application is herein incorporated by reference in its entirety to provide continuity of disclosure.

BACKGROUND OF THE INVENTION

The present invention relates to coolers. More particularly, the present invention provides for at least a cooler with a removable tub dimensioned to fit within the interior volume.

Many people enjoy packing food and beverages to take with them on a trip. However, some food and medicine must be stored at low temperatures to prevent spoilage. Coolers are an easy and convenient way to store such items, in that a cooler allows an individual to keep items stored therein at a low temperature. Utilization of a cooler enables an individual to bring such delicate items with them on long trips away from refrigeration.

Devices have been disclosed in the art that relate to coolers. However, these devices have several drawbacks. Traditional coolers require large amounts of ice to keep the interior cold. Items that a user intends to keep cold are typically interspersed with the ice in order to ensure that the items are kept cold. In this manner, organizing and/or stacking items in a cooler can be quite difficult. As such, an individual must dig through the freezing ice in order to find specific items. Additionally, as the ice melts in the cooler, water accumulates in the bottom and soaks the items stored therein. In order to protect the items, a user must guard these items by enclosing them in waterproof packaging.

The present invention substantially diverges in design elements from the known art and consequently it is clear that there is a need in the art for an improvement to existing coolers. Accordingly, a cooler that incorporates a removable tub dimensioned to fit within the interior volume, thereby separating the ice from the item stored therein, is desired.

SUMMARY OF THE INVENTION

In view of the foregoing disadvantages inherent in the known types of coolers now present in the prior art, the present invention provides a cooler with a secondary compartment wherein the same can be utilized for providing convenience for the user when separating items desired to be stored at cold temperatures without exposing said items to direct contact with the material supplying the cold temperatures, such as ice. The present cooler with a secondary compartment comprises a base, at least one sidewall disposed around a perimeter of the base, and a selectively removable tub dimensioned to fit within an interior volume.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
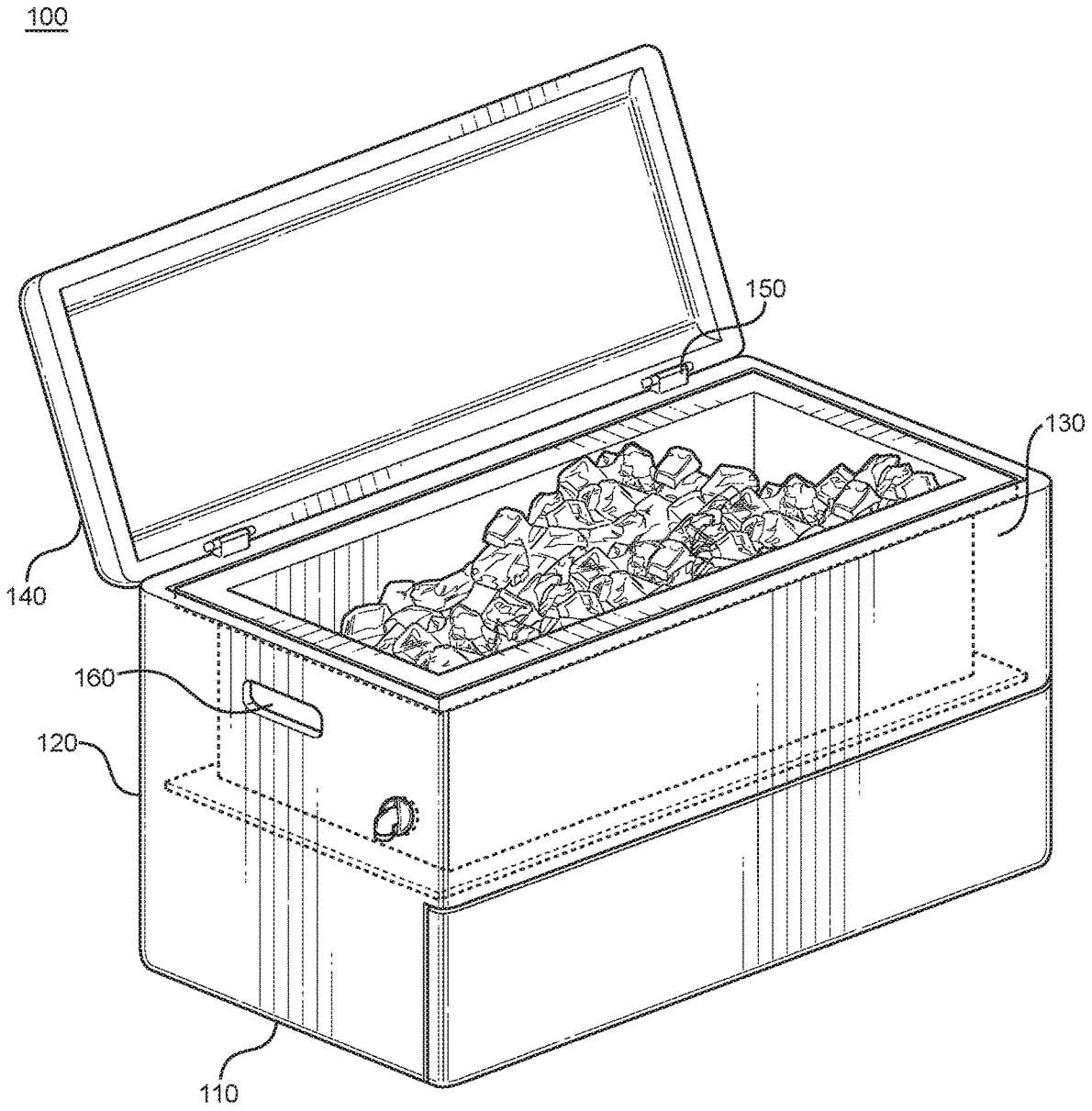
FIG. 1 shows a perspective view of an embodiment of the cooler with a secondary compartment.

Reference is made herein to the attached drawings. Like reference numerals are used throughout the drawings to depict like or similar elements of the cooler with a secondary compartment. For the purposes of presenting a brief and clear description of the present invention, a preferred embodiment will be discussed as used for the cooler with a secondary compartment. The figures are intended for representative purposes only and should not be considered to be limiting in any respect.

FIG. 1 shows a perspective view of an embodiment of the cooler with a secondary compartment. The cooler with a secondary compartment 100 has a base 110 and at least one sidewall 120 disposed around a perimeter of the base 110 thereby defining an interior volume 130. In one embodiment the base 110 and the at least one sidewall 120 can comprise a thermally insulating material such that the interior volume 130 can be thermally insulated from the temperatures outside the interior volume 130. It should be understood by one of ordinary skill in the art that the thermally insulating material can comprise multiple layers and the base 110 and the at least one sidewall 120 can similarly comprise multiple layers, thereby providing thermal insulation to the interior volume 130. In this manner, vacuum, air, or other materials can be disposed between the layers of thermally insulating material to add to the effectiveness of the insulation.

A lid 140 can be removably secured to an open end of the sidewall 120. In one embodiment the lid 140 can also comprise a thermally insulating material. The lid 140 can be configured to rest against the at least one sidewall 120 such that a thermal seal is formed. In such a manner the interior volume 130 can be thermally insulated from the temperatures outside the interior volume 130 when the lid is closed. In one embodiment the lid 140 is secured to the at least one sidewall 120 by at least one hinge 150. In such a manner the lid 140 is securely attached to the at least one sidewall 120 and the interior volume 130 can be accessed by utilizing the hinge 150 to open the lid 140. In another embodiment the lid 140 can be removably securable to the at least one sidewall 120. In such an embodiment the lid 140 and the at least one sidewall 120 can further comprise a latch system to secure the lid 140 to the at least one sidewall 120. One of ordinary skill in the art will understand that this disclosure is not limiting in any way the manner in which the lid 140 is secured to the at least one sidewall 120.

In the shown embodiment handholes 160 are disposed on opposing sides of the at least one sidewall 120. Such handholes 160 are configured to receive an individual's fingers therethrough, enabling the individual to pick up the cooler with a secondary compartment 100. In one embodiment rings are disposed on opposing sides of the at least one sidewall 120. In the same manner as the handholes 160, said rings are configured to receive an individual's fingers such that the rings can be utilized to enable a person to carry the cooler with a secondary compartment 100 via the rings. In various other embodiments, handles, protrusions or similar features may be disposed on the exterior of the at least sidewall 120 to enable an individual to carry the cooler with a secondary compartment 100 therewith.

Figure 2:
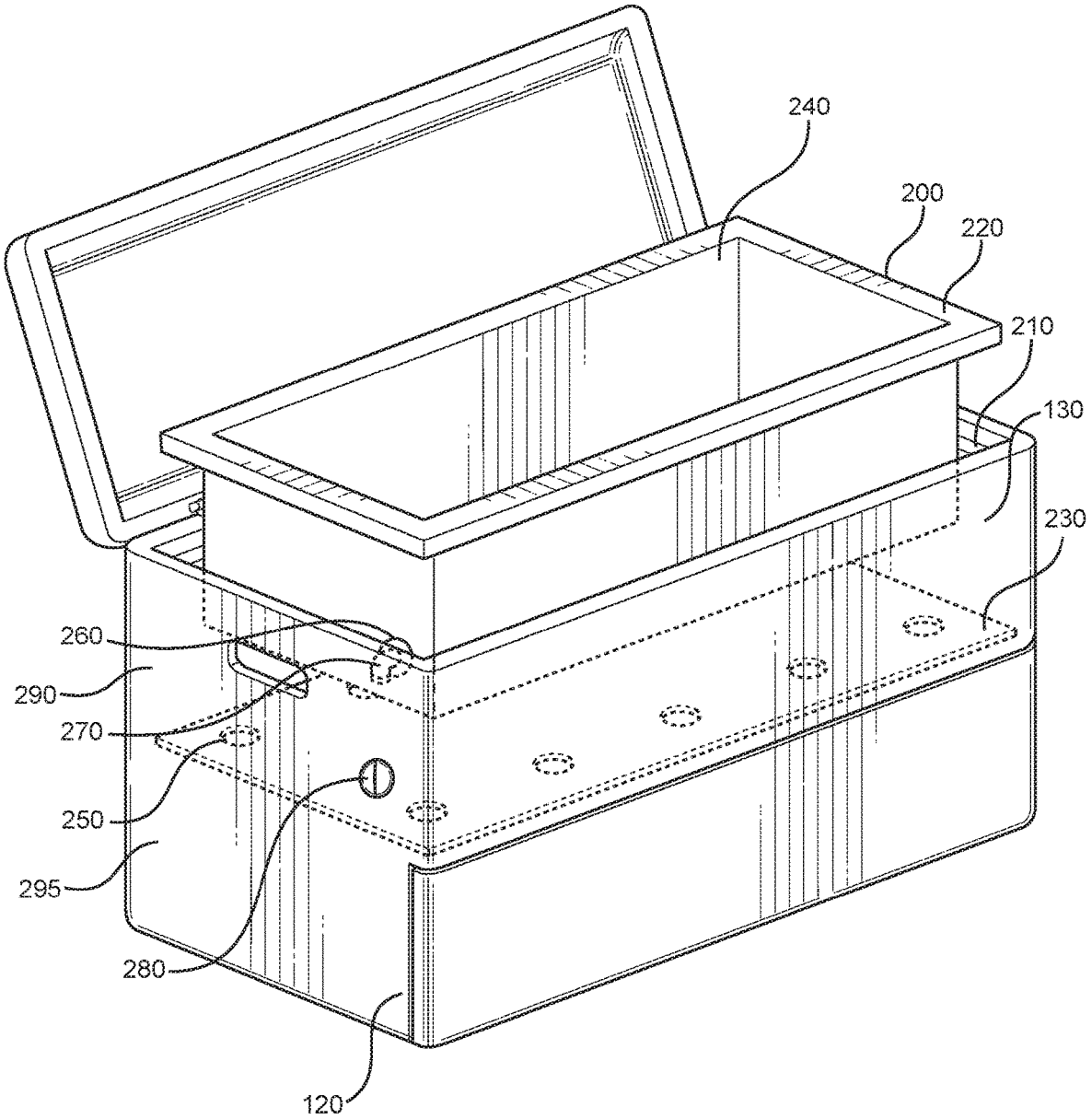
FIG. 2 shows a perspective view of an embodiment of the cooler with a secondary compartment, with a focus on the removable tub partially removed from the cooler.

FIG. 2 shows a perspective view of an embodiment of the cooler with a secondary compartment, with a focus on the removable tub partially removed from the cooler. A selectively removable tub 200 can be dimensioned to fit within the interior volume 130. The tub interior 240 can be configured to receive ice, ice packs, or similar items to cool the interior volume 130. The removable tub 200 can be comprised of a thermally conductive material such that where the removable tub 200 contains cold items, such as ice or ice packs, the cold temperature can be transferred to the surrounding space, including the interior volume 130. In one embodiment the thermally conductive material can comprise aluminum to facilitate heat transfer from the surrounding space to the tub interior 240. In this manner, a temperature of the surrounding space, including the interior volume 130, is decreased upon transfer of heat therefrom into the tub interior 240.

In the shown embodiment the removable tub 200 is sized such that the removable tub 200 does not fill the entire interior volume 130. In a further embodiment the height of the removable tub 200 can be less than the height of the at least one sidewall 120. In such a manner the removable tub 200 can divide the interior volume 130 into multiple parts. In one embodiment the removable tub 200 can further comprise grips on the sides of the removable tub 200 to aid a user in lifting and replacing the tub into the interior volume 130.

Utilization of the removeable tub 200 can allow a user to subdivide the interior volume 130 into multiple parts that can be utilized to store various items. For example, an individual may utilize the removable tub 200 to hold ice, thereby cooling the interior volume 130 of the cooler with a secondary compartment. The individual may further utilize that portion of the interior volume 130 surrounding the removable tub 200 to store desired items such as food or beverages. In such a manner the desired items, such as food or beverages, may be kept cold as heat from the surrounding space and the desired items is transferred therefrom, to the ice in the removable tub 200. By utilizing the space surrounding the removable tub 200 in such a manner, an individual may organize and store the desired items without the desired items coming into direct contact with the ice stored in the removable tub 200. In this manner, when the ice melts, the desired items do not become wet.

In the shown embodiment a lip 210 is disposed about the interior upper perimeter of the at least one sidewall 120. The lip 210 is configured to support a corresponding protrusion 220 disposed on the exterior upper perimeter of the removable tub 200. In such a manner the removeable tub 200 can be configured to hang from the lip 210 by utilization of the protrusion 220. In such a manner a first compartment 290 is defined as the interior volume 240 of the removable tub, and a second compartment 295 is defined as that portion of the interior volume 130 underneath the removable tub 200.

In one embodiment, at least one interior shelf 230 is disposed in the interior volume 130 underneath the removable tub when the removable tub is fully inserted into the interior volume 130. The at least one shelf 230 can be comprised of thermally conductive materials such that heat from the secondary compartment 295 can be transferred through the shelf 230. The at least one interior shelf 230 can be configured to receive the removable tub 200. In such a manner, the at least one interior shelf 230 can be secured to the interior of the at least one sidewall 120 in such a manner as to be strong enough to support the full weight of the removable tub 200 when the removable tub is filled with ice, or other items.

In the shown embodiment the length and width of the interior shelf 230 is the same as the length and width of the interior of the cooler with a secondary compartment. In other embodiments the interior shelf 230 can be sized and disposed as a portion of the interior volume. In such a manner an interior shelf 230 may be sized to correspond with a removable tub 200 that is smaller than the interior volume 130 of the cooler with a secondary compartment. In other embodiments multiple interior shelves 230 may be disposed in the interior volume 130.

In one embodiment, the first compartment 290 is in thermal communication with the secondary compartment 295. In the shown embodiment the interior shelf 230 comprises a plurality of holes 250. The plurality of holes 250 can be disposed throughout the interior shelf 230 such that the heat from the secondary compartment 295 can easily and freely flow to the first compartment 290. The plurality of holes 250 provide the added benefit of reducing the amount of material used in, and therefore the total weight of, the cooler with a secondary compartment. In other embodiments the interior shelf 230 can comprise thermally conductive materials such that the heat can be communicated from the secondary compartment 295 into the first compartment 290. In the shown embodiment the plurality of holes 250 are evenly distributed throughout the interior shelf 230. It is contemplated by this disclosure that many different configurations of how the plurality of holes 250 are disposed on the interior shelf 230 are possible and embody the present invention.

In the shown embodiment a drain 260 is disposed on a bottom corner of the removable tub 200. In one embodiment, the bottom of the removable tub 200 can be angled such that the lowest part of the removable tub 200 is in the corner in which the drain 260 is located. In this manner, water or other fluids inside the removable tub 200 will collect at the corner with the drain 260. A spigot 270 is in fluid communication with the drain 260 which can be opened in order to allow fluids collected at the drain 260 to be released and emptied from the removable tub 200. Further, in the shown embodiment, a waterproof and thermally insulated seal 280 is disposed in the sidewall 120, configured to receive the spigot 270 therethrough. In such a manner, where the removable tub 200 is disposed in the interior volume 130, the spigot 270 can be utilized to drain a fluid collected at the drain 260 without removing the removable tub 200 from the interior volume 130. Where the removeable tub 200 is not disposed in the interior volume 130, the waterproof and thermally insulated seal 280 remains closed and maintains the integrity and temperature of the cooler with a secondary compartment.

Figure 3:
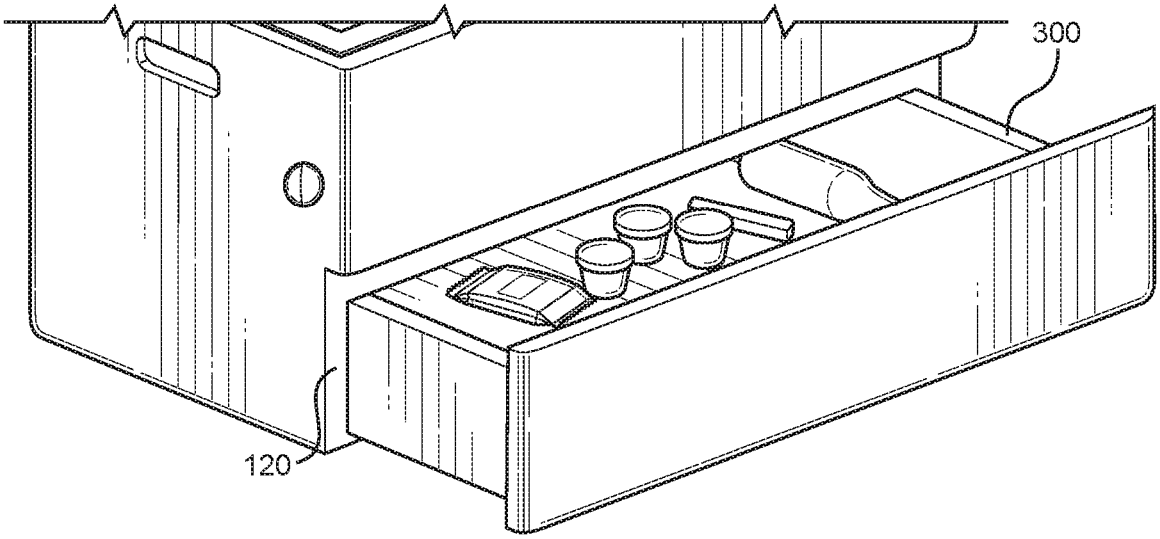
FIG. 3 shows a perspective view of an embodiment of the cooler with a secondary compartment, with a focus on a slidably removable drawer.

FIG. 3 shows a perspective view of an embodiment of the cooler with a secondary compartment, with a focus on a slidably removable drawer. In the shown embodiment a drawer 300, dimensioned to fit within the interior volume 130, can be slidably removable. In such an embodiment, when the drawer is closed a thermal seal is formed. It should be understood by one of ordinary skill in the art that various way of securing the drawer to the sidewall, including drawer runners disposed on the interior of the sidewalls, and complementary drawer slides disposed on the exterior side of the drawer, are contemplated by this disclosure. In the shown embodiment the drawer 300 is operably connected to a front bottom portion of the at least one sidewall 120. The drawer 300 is configured to slide into the interior volume 130. Where the drawer is inside the interior volume 130, in a closed configuration, heat from the drawer and items placed therein can flow to the colder interior volume 130. An individual can place items in the drawer that they desire to be kept cold, without direct exposure to the items in the first compartment generating the cold, such as ice. In such a manner items in the drawer 300 can be kept cold and dry and can be organized in such a way as to make finding a particular item easier for a user. In a further embodiment, additional dividers can be disposed in the drawer 300 to further aid a user in organizing items being stored.

Figure 4:
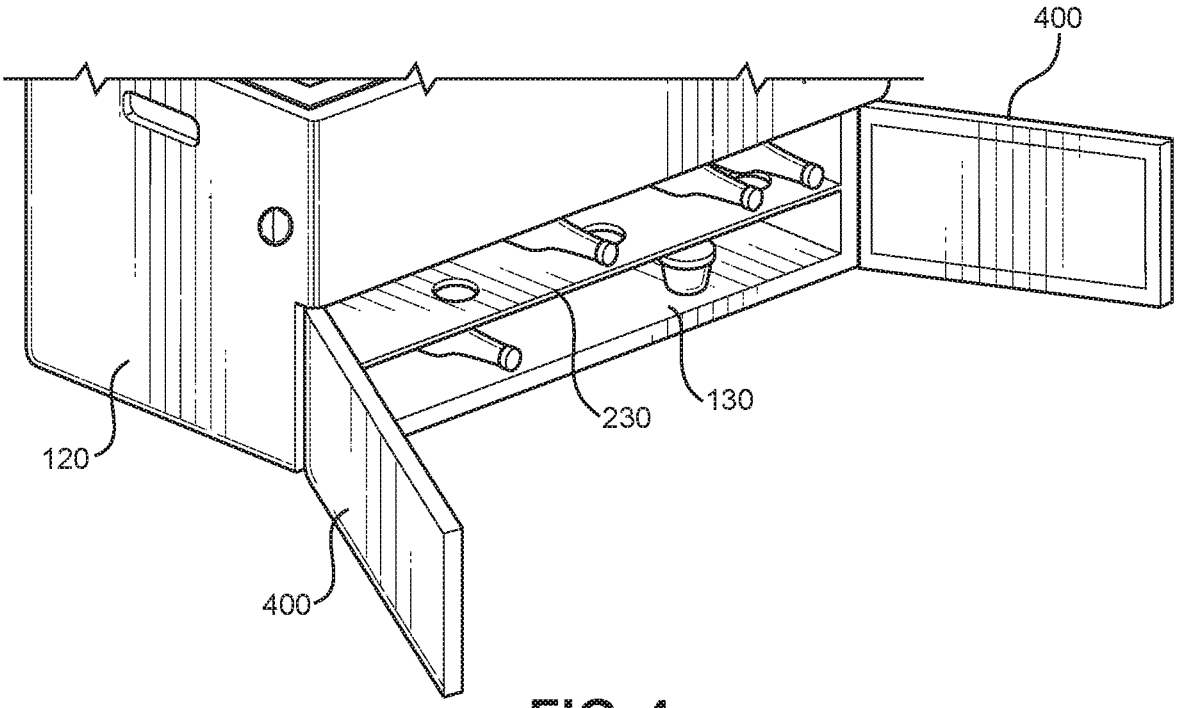
FIG. 4 shows a perspective view of an embodiment of the cooler with a secondary compartment, with a focus on a pair of doors and an interior shelf.

FIG. 4 shows a perspective view of an embodiment of the cooler with a secondary compartment, with a focus on a door 400 and an interior shelf 230. In one embodiment, at least one door 400 can be disposed on the sidewall 120 wherein the door 400 provides access to the interior volume 130. In the shown embodiment the door 400 is operably connected to a front bottom portion of the at least one sidewall 120. In the shown embodiment the doors 400 can provide access to the secondary compartment of the interior volume 130. In such a manner, the doors 400 can provide access to a space an individual can utilize to store items. Such a space can be cold where items in the first compartment, such as ice, keep the entire interior volume 130 cold. In the shown embodiment a shelf 230 is disposed in such a space in order to further aid an individual in organized the stored items. The shelf 230 can be comprised of thermally conductive materials such that heat can be transferred through the shelf 230.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cooler with a secondary compartment, comprising:

a base;

at least one sidewall disposed around a perimeter of the base, thereby defining an interior volume;

wherein the base and the at least one sidewall comprise a thermally insulating material;

a lid removably securable to an open end of the sidewall;

a tub dimensioned to fit within the interior volume, thereby defining a first compartment and a secondary compartment;

wherein the tub is removable from the interior volume;

wherein the tub comprises a thermally conductive material;

the thermally conductive material configured to enable a cold temperature to be transferred from the secondary compartment to the first compartment and from the first compartment to the secondary compartment;

further comprising at least one door operably connected to a front bottom portion of the sidewall;

the at least one door providing access to the second compartment.

2. The cooler with a secondary compartment of claim 1, further comprising at least one interior shelf disposed in the second compartment.

3. The cooler with a secondary compartment of claim 1, wherein the lid is hingedly affixed to the open end of the sidewall.

4. The cooler with a secondary compartment of claim 1, further comprising a lip disposed around a perimeter of an interior upper end of the sidewall.

5. The cooler with a secondary compartment of claim 4, wherein the tub further comprises a protrusion disposed around a perimeter of an exterior upper end of the tub, wherein the protrusion is configured to be supported upon the lip.

6. The cooler with a secondary compartment of claim 1, wherein the at least one interior shelf is composed of thermally conductive material.

7. The cooler with a secondary compartment of claim 1, wherein the door is a slidably removable drawer operably connected to a front bottom portion of the sidewall.

8. The cooler with a secondary compartment of claim 1, wherein the sidewall further comprises handholes.

9. The cooler with a secondary compartment of claim 1, wherein the tub further comprises a drain fluidly connected to a spigot.

10. The cooler with a secondary compartment of claim 9, wherein the sidewall further comprises a seal, configured to receive the spigot therethrough.

11. The cooler with a secondary compartment of claim 10, wherein the seal is configured to be watertight.

12. The cooler with a secondary compartment of claim 11, wherein the seal is further configured to be thermally insulated.

13. A cooler with a secondary compartment, consisting of:

a base;

at least one sidewall disposed around a perimeter of the base, thereby defining an interior volume;

wherein the base and the at least one sidewall comprise a thermally insulating material;

a lid removably securable to an open end of the sidewall;

a tub dimensioned to fit within the interior volume, thereby defining a first compartment and a secondary compartment;

wherein the tub is removable from the interior volume;

wherein the tub comprises a thermally conductive material;

the thermally conductive material configured to enable a cold temperature to be transferred from the secondary compartment to the first compartment and from the first compartment to the secondary compartment;

further comprising at least one door operably connected to a front bottom portion of the sidewall;

the at least one door providing access to the second compartment.

* * * * *